United States Patent [19]

Hawkins

[11] 4,369,148

[45] Jan. 18, 1983

[54] SUPPLANTARY RESERVOIR FOR EVAPORATIVE COOLER

[76] Inventor: Warren H. Hawkins, 3602 E. Monte Cristo, Phoenix, Ariz. 85032

[21] Appl. No.: 284,830

[22] Filed: Jul. 20, 1981

[51] Int. Cl.[3] ..... B01F 3/04

[52] U.S. Cl. ..... 261/36 R; 62/310; 62/DIG. 16; 98/30; 261/29; 261/106; 261/DIG. 3; 261/DIG. 46

[58] Field of Search ..... 261/29, 36 R, DIG. 3, 261/DIG. 4, DIG. 41, DIG. 46, 103, 106; 62/310, DIG. 16; 98/2.11, 2.14, 30

[56] References Cited

U.S. PATENT DOCUMENTS

| | | | |
|---|---|---|---|
| 2,874,032 | 2/1959 | Kuehner | 261/29 X |
| 2,998,714 | 9/1961 | Bonzer | 261/DIG. 4 |
| 3,290,020 | 12/1966 | Findley | 261/29 |
| 3,306,591 | 2/1967 | Valazza | 261/29 X |
| 3,314,080 | 4/1967 | Shilling, Jr. | 261/DIG. 46 |
| 3,606,982 | 9/1971 | Anderson | 261/29 |
| 3,742,659 | 7/1973 | Drew | 62/DIG. 16 |
| 4,192,832 | 3/1980 | Goettl | 261/36 R |
| 4,234,526 | 11/1980 | Mackay et al. | 261/29 X |
| 4,261,930 | 4/1981 | Walker | 261/DIG. 4 |

*Primary Examiner*—Richard L. Chiesa
*Attorney, Agent, or Firm*—James F. Duffy

[57] ABSTRACT

An supplantary reservoir supplants the original integral reservoir of an evaporative cooler eliminating the necessity for accumulating water in said original integral reservoir. The water circulating pump and float controlled valve of the original, conventional cooler may be transferred physically and functionally to the supplantary reservoir. Communication of water from the conventional cooler to and from the supplantary reservoir is by means of the drain opening in the base of the original integral reservoir. The supplantary reservoir is readily accessible providing easy maintenance thereof and inexpensive replacement if necessary.

10 Claims, 3 Drawing Figures

SUPPLANTARY RESERVOIR FOR EVAPORATIVE COOLER

BACKGROUND OF THE INVENTION

1. Field of the Invention

The invention relates to improvements in the field of evaporative coolers.

The invention particularly relates to the field of reduction of hard water deposits and their corrosive effects in the reservoir of a conventional evaporative cooler.

The invention specifically relates to the use of an auxiliary reservoir to supplant the existing reservoir of a conventional evaporative cooler.

2. Prior Art

Evaporative coolers are an important means of cooling residences and other buildings in the arid southwestern portion of the country. This region, extending from the deserts of California to those of Texas, is a region of high temperature and low relative humidity. It is the low relative humidity which makes it feasible to cool buildings by the use of evaporative coolers. Air is forced past and through a water saturated pad. In its passage it causes the evaporation of water from this pad which reduces the temperature of the air. This cooled, moisture laden air is then passed to the interior of the building to both cool the building and raise the relative humidity therein.

In maintaining the evaporative cooling pads saturated with water, the usual procedure is to provide a water reservoir in the base of the cooler and to pump water from the reservoir to the top of the evaporative pads. The water is distributed to the top of the pad and is dispersed downward therethrough under the influence of gravity. Excess water exiting from the base of the pad returns to the reservoir.

Because water is constantly being evaporated as air is forced past and through the evaporative cooler pads, a replenishment water supply is required. This is generally achieved by connecting a float control valve to a water supply. The float control valve monitors the level of water within the reservoir. When the water level is lowered due to the evaporative action of the cooler, the float valve is operative to permit water from the water supply to enter into the reservoir thereby replenishing the water and once more raising the float valve to the level at which the valve inhibits entry of additional water.

With the constant evaporation required for proper cooling effect, the water reservoir soon becomes saturated with salts dissolved within the incoming water. These residues soon appear and form a slime at the base of the reservoir. The reservoir and other parts of the cooler require regular cleaning if the implacable progress which this slime makes in advancing up the walls and to the outside of the cooler surfaces is to be prevented. Those skilled in the prior art have attempted to ease the burden on the person performing the maintenance on the evaporative coolers. In U.S. Pat. No. 3,290,020 issued to Findley Dec. 6, 1966, luggage-type latches are employed to permit the ready disassembly of the evaporative cooler enclosure to permit ready access to the interior of the cooler and the reservoir therein. This somewhat relieves the burden of cleaning and painting this interior.

Mackay et al, in U.S. Pat. No. 4,234,526 issued Nov. 18, 1980 also employs a quick-release latching mechanism in an evaporative cooler having a one-piece, frameless shell secured to a bottom pan and a top cover. The top cover was readily opened to permit easy access to the components of the evaporative cooler housed within the frame.

While inventions such as these noted above permit a ready access into the evaporative cooler enclosure, the task still remains of removing the water salts from the base of the reservoir. Lack of care on at least an annual basis can result in the corrosive failure of the reservoir in four to five cooling seasons.

It is an objective of the present invention to reduce the buildup of corrosive salts within the reservoir of a conventional evaporative cooler device.

It is a further object of the invention to simply and readily modify existing conventional coolers such that the base of these conventional coolers no longer serve as a reservoir of water to be used for circulating to the evaporative cooling pads.

It is a specific objective of the invention to provide a readily removable, easily replaceable auxiliary reservoir which supplants the original reservoir provided with the conventional evaporative cooler device.

SUMMARY OF THE INVENTION

The invention is an improvement to a conventional evaporative cooler. The conventional evaporative cooler provides means for passing air past and through evaporative cooling pads which pads are maintained saturated with water drawn by water circulating means from a reservoir which forms part of the base of said cooler. The water within the reservoir is maintained by a float controlled valve which couples a source of water to the reservoir. Means are also provided to the reservoir for draining water therefrom when it is desired to do so. The improvement of the invention comprises an auxiliary water retention vessel external to the evaporative cooler supplanting the reservoir and coupled thereto by the means for draining water from said reservoir.

The improvement further comprises means for supporting the auxiliary supplantary water retention vessel external to said cooler.

As is usual, the conventional evaporative cooler further comprises means for mounting the cooler above a stable base. In the improvement of the invention the means for supporting the auxiliary supplantary water retention vessel external to the cooler comprises vessel support means which are coupled to said cooler mounting means. Frequently the cooler mounting means for the conventional evaporative cooler is configured to mount the cooler above the sloping roof of a residence or other building. In such instance the vessel support means comprises a support shelf which is coupled interior to the means for mounting the cooler above the sloping shelf. So too, where means are provided for mounting the cooler above a level surface, similar means are provided for supporting the vessel therein.

With the improvement of the auxiliary supplantary water retention vessel, means for coupling said vessel to a source of water are also provided. In the embodiment disclosed this coupling means comprises a float controlled valve. Ideally, that float control valve comprises the same float control valve originally used to maintain water within the reservoir of the conventional evaporative cooler.

Water circulating means for drawing water from the auxiliary supplantary water retention vessel and coupling that water to the evaporative cooling pads to maintain the pads saturated with water are also provided. In the embodiment preferred this water circulating means comprises the same water circulating means originally used to draw water from the reservoir of the original conventional evaporative cooler to saturate the evaporative pads therein.

DETAILS OF THE INVENTION

Figure 1:
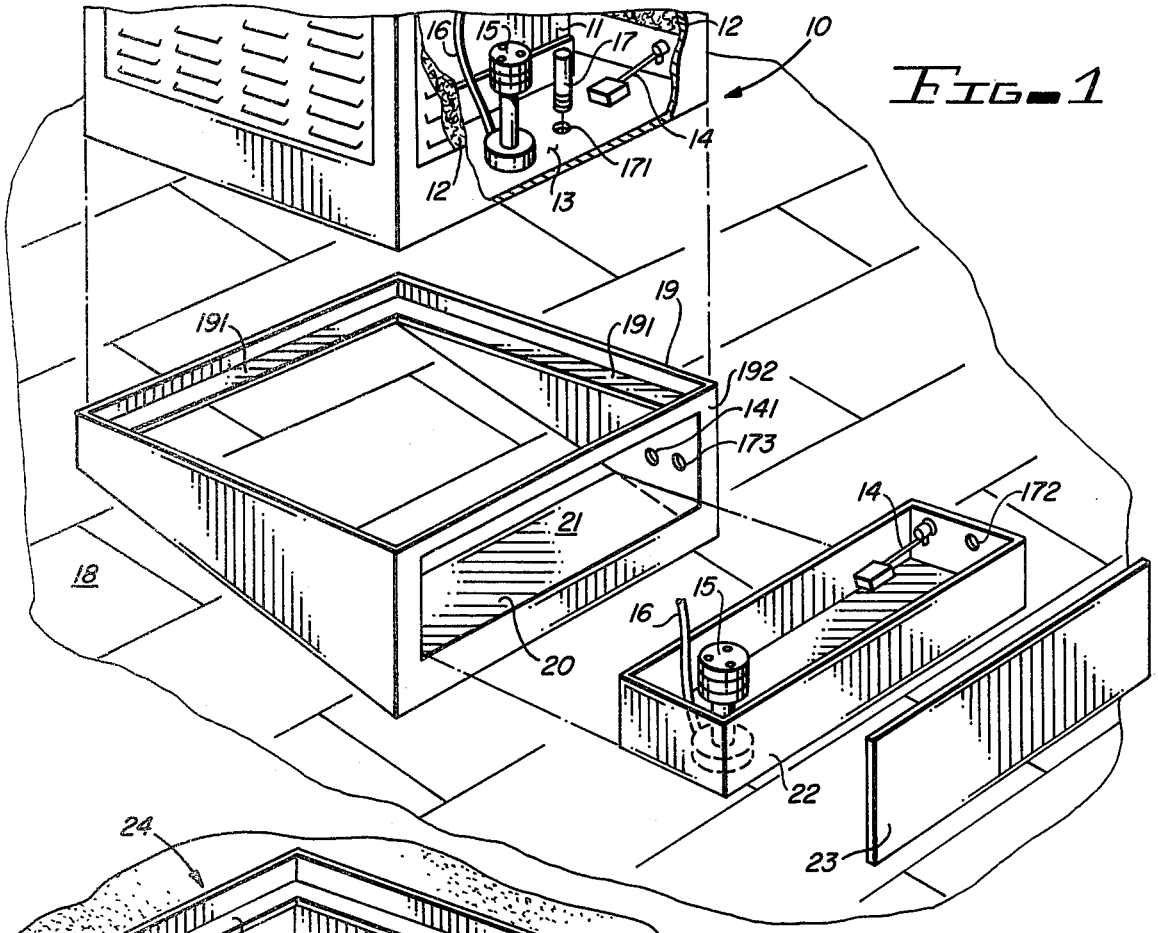
FIG. 1 is an exploded perspective view of the invention in an embodiment associated with a conventional evaporative cooler which is mounted on a sloping roof.

A conventional evaporative cooler 10 is illustrated in a partial sectional perspective view in FIG. 1. The conventional cooler 10 comprises a fan housing 11 which houses a fan employed to draw air through evaporative cooling pads 12. Evaporative cooling pads 12 are maintained saturated with water drawn from a reservoir 13 which is integral with the base of cooler 10. The water level within reservoir 13 is maintained by float control valve 14 which couples the reservoir to a source of water, not shown. A water circulating pump 15 draws water from reservoir 13 and passes it through hose 16 to the top of evaporative cooler pads 12 in conventional manner well known to those skilled in the art.

As is typical, an overflow pipe 17 fitted to a threaded drain 171 in the base of reservoir 13 is provided to draw off excess water from reservoir 13 should float controlled valve 14 malfunction.

In the embodiment of FIG. 1, cooler 10 is shown mounted to support 19 which provides a horizontal mounting platform 191 for supporting cooler 10 above the stable base provided by sloping roof 18. While those skilled in the art will be familiar with mounting bases configured such as that of base 19 illustrated in FIG. 1, base 19 is here modified by providing an opening 20 in vertical face 192 of base 19. Opening 20 provides access to a horizontal shelf 21 coupled interior of base 19.

Shelf 21 provides support for an auxiliary water retention vessel 22 which, in accordance with the teachings herein, will supplant reservoir 13 of conventional cooler 10. Further modification in support base 19 is made by the provision of access openings 141 and 173 whose purpose will be disclosed in the discussion which follows.

In practicing the invention, it is desired to supplant the reservoir 13 of conventional cooler 10 with an auxiliary reservoir provided by water retention vessel 22. In this manner water will no longer accumulate within reservoir 13. Salt deposit buildups within reservoir 13 will thus be minimized. Water retention vessel 22 in an inexpensive, easily replaced auxiliary reservoir which is employed as follows.

Water circulating pump is removed from conventional cooler 10 and emplaced within the auxiliary reservoir 22. Hose 16, utilized for circulating water to the top of evaporative cooler pads 12 for purposes of saturating said pads is fed through drain hole 171 after overflow pipe 17 is removed.

In a similar fashion float controlled valve 14 is removed from cooler 10 and installed in auxiliary reservoir 22 as illustrated in FIG. 1. Drain hole 172 is provided to draw off water from auxiliary reservoir 22 should float control valve 14 malfunction. In practice, drain opening 172 would be provided with a hose coupling to permit the overflow water to be directed outward from vessel 22 to a proper drain site. Access openings 141 and 173 in the side wall of base mount 19 provide access to float control valve 14 and overflow opening 172 respectively.

When auxiliary water retention vessel 22 is placed on support shelf 21 with water circulating pump 15 and float control valve 14 emplaced as indicated in FIG. 1, water will be circulated upwards through hose 16 which, as already noted, passes through drain 171 in the base of reservoir 13 and conveys circulating water to the top of evaporative cooling pads 12 to maintain them in a saturated condition. Water returning to the base of pads 12 flows across the base of reservoir 13 and enters drain hole 171 from whence it passes into auxiliary water retention vessel 22.

Water circulating pump 15 maintains the water in auxiliary reservoir 22 in circulation while float control valve 14 maintains the water level within auxiliary reservoir 22.

To remove auxiliary reservoir from support base 19, the couplings between the water source and float control valve 14 are disconnected and, similarly, the hose connections between the drainage hose, not shown, and overflow drain 172 are uncoupled. Auxiliary reservoir 22 may then be readily drawn from the interior of base 19 where it had been supported upon shelf 21. A first partial withdrawing of auxiliary reservoir 22 will permit circulating pump 15 to be lifted from the auxiliary reservoir. Auxiliary reservoir 22 may then be removed for cleaning or total replacement if necessary. Cleaning of the auxiliary reservoir 22 is accomplished in an easier manner than would be required if necessary to gain access to reservoir 13 of cooler 10. Should auxiliary reservoir 22 suffer damaging effects from corrosion it may readily and inexpensively be replaced.

While auxiliary reservoir 22 is in position beneath cooler 10 and supported on shelf 21 within base 19, access to the auxiliary reservoir 22 is denied by cover plate 23 which is fastened to face 192 of mounting base 19 in any convenient, well known manner.

Figure 2:
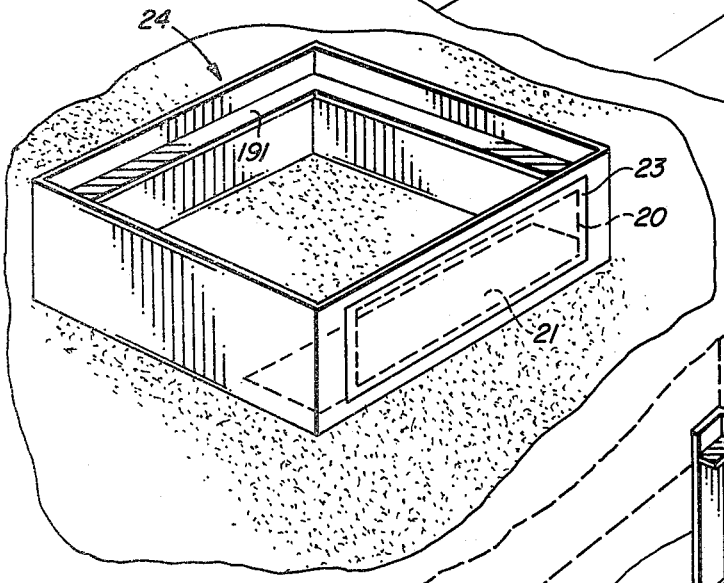
FIG. 2 is a perspective view of the mounting base employed with a conventional evaporative cooler showing the modifications to be made to that base to permit it to support the auxiliary supplantary water retention vessel of the invention.

Frequently an enclosed base 24 of FIG. 2 will be provided for supporting cooler 10 above a horizontal stable base such as a flat roof or a concrete pad at ground level. Again such mounting bases as that of 24 are well known to those skilled in the art and they provide a horizontal platform 191 for the support of cooler 10. In practicing the invention, base 24 would be modified in a similar fashion as was base 19. A horizontal shelf 21 is provided interior to base 24. Access to shelf 21 is provided through opening 20 with such access being denied when desired by the emplacement of cover plate 23 over opening 20. Auxiliary reservoir 22 is mounted to shelf 21 of base 24 in the manner already described with respect to base 19.

Figure 3:
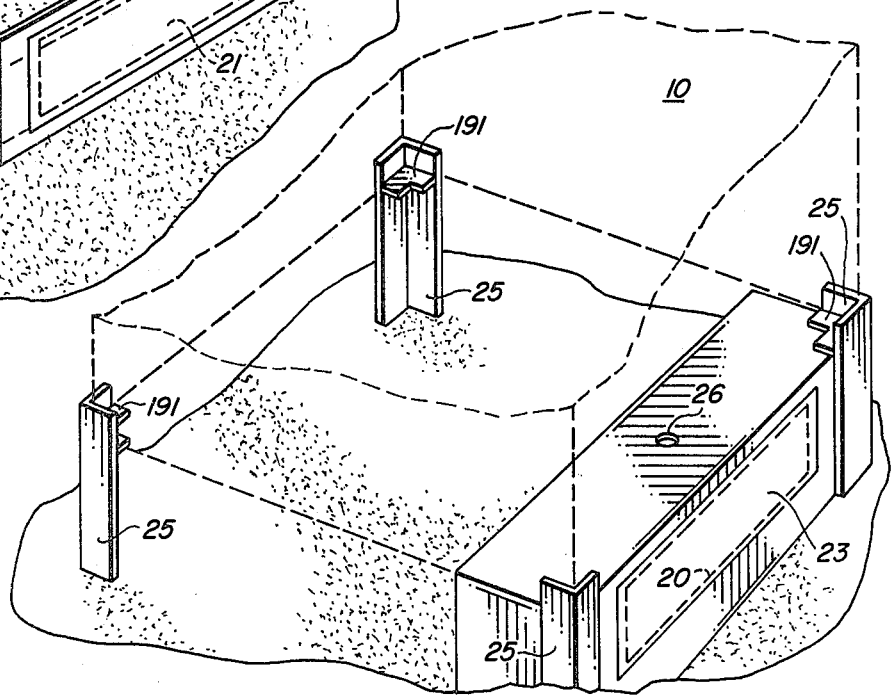
FIG. 3 illustrates four legs used to support a conventional evaporative cooler above a stable base and indicates the means whereby an auxiliary supplantary water retention vessel may be supported beneath, and exterior to, a conventional evaporative cooler.

Occasionally, instead of a mounting base 24, four legs 25 are provided at each corner of cooler 10. Each of legs 25 provide a horizontal support surface 191 to support cooler 10. For use of the invention, an enclosure 27 is emplaced within the confines of legs 25 so as to be located exterior to and beneath cooler 10. An opening 26 aligns with drain 171 in the base of reservoir 13 of cooler 10 and permits the flow of water through drain 171 to pass into auxiliary reservoir 22 which will be supported within enclosure 27. As already set forth in the other embodiments access to the auxiliary reservoir 22 within enclosure 27 will be through access opening 20. Again such access will be denied by emplacement of cover plate 23 over access opening 20. As would be expected, hose 16 is passed through opening 26 and thence through drain 171 in passing from circulating pump 15 to cooler 10 when the auxiliary reservoir is emplaced within enclosure 27 of FIG. 3.

What has been disclosed is a supplantary reservoir for use with a conventional evaporative cooler. The supplantary reservoir supplants the reservoir which is integral with the conventional cooler and provides a readily accessible, easily maintained, and inexpensively replaced water retention vessel which supplants the reservoir within the conventional cooler and eliminates the necessity for the accumulation of water within said conventional, integral reservoir. The supplantary reservoir is coupled to the conventional cooler by means of the drain in the base of the reservoir of the cooler. The original circulating pump and float control valve of the conventional cooler may be removed therefrom and employed within the supplantary reservoir. The hose used for saturating the evaporative cooling pads is passed from the circulating pump within the supplantary reservoir through the drain in the base of the original integral reservoir of cooler 10.

While those skilled in the art will conceive of other embodiments of the invention drawn from the teachings herein it is intended that all such embodiments so drawn shall fall within the ambit of protection of the appended claims.

Having set forth my invention in the foregoing specification and the accompanying drawings in such clear and concise manner that those skilled in the art may readily understand and easily practice the invention, that which I claim is:

1. In an evaporative cooler having means for passing air past and through evaporative cooling pads which pads are maintained saturated with water drawn by water circulating means from a reservoir forming part of the base of said cooler said water being maintained within said reservoir by a float controlled valve coupling a source of water to said reservoir said reservoir being further provided with means for draining water from the base of said reservoir when desired to do so, the improvement comprising:

a supplantary water retention vessel external to said evaporative cooler supplanting said reservoir and coupled thereto by said means for draining water from the base of said reservoir to preclude the accumulation and storage of water within said reservoir.

2. The improvement of claim 1 further comprising means for coupling said supplantary water retention vessel to a source of water.

3. The improvement of claim 2 wherein said means for coupling said supplantary water retention vessel to a source of water comprises a float controlled valve.

4. The improvement of claim 3 wherein said float controlled valve comprises that float controlled valve originally used to maintain water within said reservoir.

5. The improvement of claim 4 further comprising water circulating means for drawing water from said supplantary water retention vessel and coupling same to said evaporative cooling pads to maintain said pads saturated with water.

6. The improvement of claim 5 wherein said water circulating means comprises that water circulating means originally used to draw water from said reservoir to saturate said pads.

7. The improvement of claim 1 further comprising means for supporting said supplantary water retention vessel external to said cooler.

8. The improvement of claim 7 wherein said evaporative cooler further comprises means for mounting said cooler above a stable base and said means for supporting said supplantary water retention vessel external to said cooler comprises vessel support means coupled to said cooler mounting means.

9. The improvement of claim 8 wherein said means for mounting said cooler above a stable base comprises means for mounting said cooler above a sloping roof and said vessel support means comprises a support shelf coupled interior of said means for mounting said cooler above a sloping roof.

10. The improvement of claim 9 further comprising exterior access means to said vessel when said vessel is supported on said shelf interior of said means for mounting said cooler above a sloping roof.

* * * * *